United States Patent [19]

Champayne

[11] 4,071,981

[45] Feb. 7, 1978

[54] PORTABLE ABRADING MACHINE WITH DUST COLLECTING SYSTEM

[76] Inventor: Roy J. Champayne, c/o National-Detroit, Inc., 2810 Auburn St., Rockford, Ill. 61103

[21] Appl. No.: 747,406

[22] Filed: Dec. 3, 1976

[51] Int. Cl.[2] ..... B24B 23/00

[52] U.S. Cl. ..... 51/170 MT; 51/273

[58] Field of Search ..... 51/273, 170 MT, 268, 51/170 TL, 170 R

[56] References Cited

U.S. PATENT DOCUMENTS

| | | | |
|---|---|---|---|
| 2,929,177 | 3/1960 | Sheps | 51/170 MT |
| 3,638,362 | 2/1972 | Stoll | 51/170 MT |
| 3,815,292 | 6/1974 | Hutchins | 51/170 MT |
| 3,864,784 | 2/1975 | Kilstrom | 51/170 MT |
| 3,932,963 | 1/1976 | Hutchins | 51/170 TL |
| 3,932,966 | 1/1976 | Stern | 51/170 MT |

*Primary Examiner*—Harold D. Whitehead
*Assistant Examiner*—Roscoe V. Parker
*Attorney, Agent, or Firm*—Leydig, Voit, Osann, Mayer & Holt, Ltd.

[57] ABSTRACT

An abrading machine in which an abrading shoe and a dust collecting shroud gyrate in unison, there being a hole formed through the shroud and communicating with a stationary cup in all gyrated positions of the shoe and the shroud. When suction is applied to the cup, abrading dust is sucked upwardly around the entire outer periphery of the shoe and passes into the shroud, through the hole, and then into the cup for exhaustion to a dust collecting receptacle.

3 Claims, 3 Drawing Figures

PORTABLE ABRADING MACHINE WITH DUST COLLECTING SYSTEM

BACKGROUND OF THE INVENTION

This invention relates to an abrading machine of the type having an abrading shoe which is adapted to move with non-rotary motion relative to a frame unit. An abrading machine of this general type is disclosed in my U.S. Pat. No. 2,751,725.

The invention more particularly relates to an abrading machine having a suction system for collecting the abrading dust created during operation of the machine. Machines having non-rotary abrading shoes and having dust collecting suction systems are disclosed in Hutchins U.S. Pat. Nos. 3,815,292 and Hutchins 3,932,963.

SUMMARY OF THE INVENTION

The general aim of the present invention is to provide a non-rotary abrading machine having a dust collecting system which is simpler in construction and more effective in operation than the collecting systems of prior machines.

A more detailed object is to achieve the foregoing by providing an abrading machine equipped with a unique dust shroud adapted to move in unison with the abrading shoe, the shroud having a top wall spaced above the top of the shoe and having a depending skirt extending around and spaced outwardly from the periphery of the shoe. A hollow, downwardly opening fitting is fastened rigidly to the frame unit of the machine and is sufficiently large to remain in communication with a hole in the top of the shroud regardless of the position of the shroud and the shoe. When suction is applied to the fitting, abrading dust is sucked upwardly between the skirt and the shoe, passes through the hole and into the fitting and then is sucked out of the fitting to a collection receptacle.

The invention also resides in the simple construction of the fitting and in the unique relationship between the fitting and the shroud.

These and other objects and advantages of the invention will become more apparent from the following detailed description when taken in conjunction with the accompanying drawings.

DETAILED DESCRIPTION OF THE PREFERRED EMBODIMENT

Figure 2:
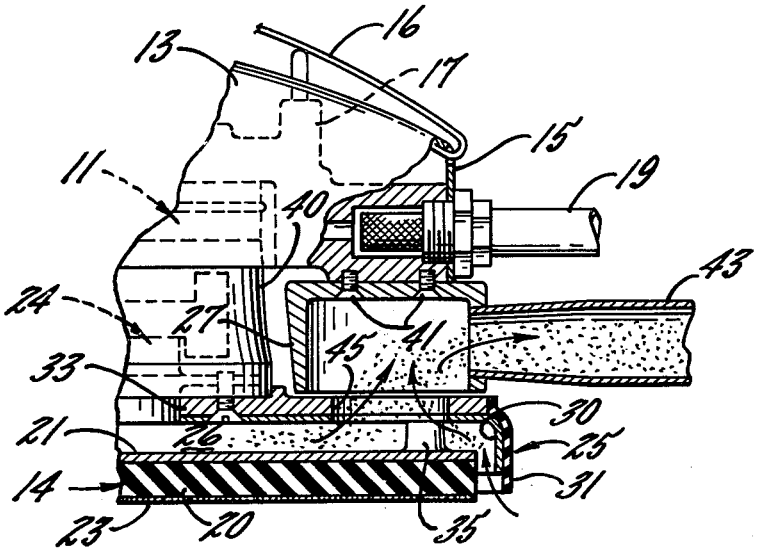
FIGS. 2 and 3 are fragmentary cross-sections taken substantially along the lines 2—2 and 3—3, respectively, of FIG. 1.

As shown in the drawings for purposes of illustration, the invention is incorporated in a portable abrading machine 10 having a rotary pneumatic motor 11 (FIG. 2) housed within a hollow frame unit or casing 13 on which an abrading shoe 14 is supported for bodily gyration. The frame casing 13 is generally dome shaped and is formed with a rearwardly projecting handle 15 which may be gripped to carry the tool, to guide it along a work surface or to apply the necessary downward pressure on the shoe. An operating lever or trigger 16 is pivotally mounted on the handle and may be depressed to open a valve 17 (FIG. 2) and admit pressurized air to the motor from a flexible line 19 extending into the rear of the handle.

The abrading shoe 14 herein is rectangular in shape and comprises a pad 20 of yieldable material such as rubber which is adhesively secured on its upper side to a metal plate 21. An abrasive sheet 23 is adhesively secured or otherwise suitably attached to the lower side of the pad.

Mechanism 24 (FIG. 2) is housed within the casing 13 for producing gyration of the abrading shoe 14 in response to operation of the motor 11. Such a drive mechanism is well known (see, for example, my aforementioned patent) and thus need not be described in detail here. It will suffice to say that all parts of the shoe gyrate bodily relative to the casing with the radius of gyration usually being about 3/32 of an inch.

In accordance with the present invention, a shroud 25 is connected to gyrate in unison with the abrading shoe 14 and defines a dust collecting chamber 26 around and above the shoe. A hollow fitting 27 is secured rigidly to the casing 13 and communicates with the chamber 26 in all gyrated positions of the shoe. By applying suction to the fitting 27, abrading dust produced by operation of the machine 10 may be sucked from around the shoe 14 and into the chamber 26 and the fitting for subsequent exhaustion to a collection receptacle (not shown).

Figure 3:
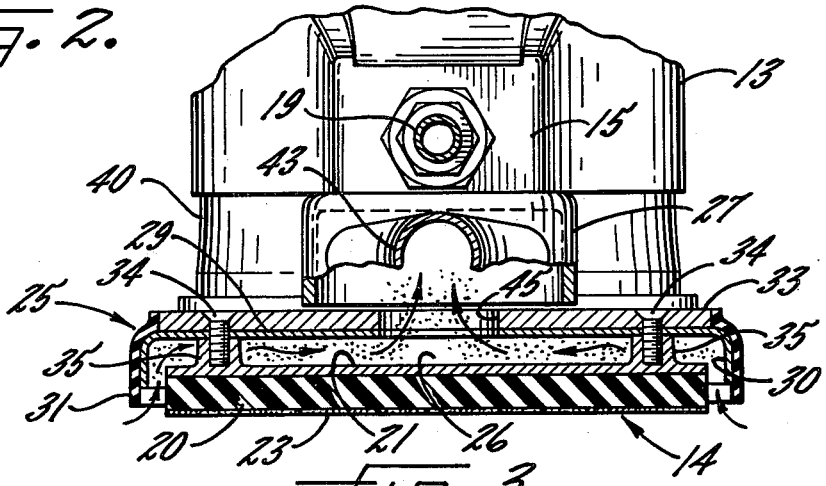

More specifically, the shroud 25 is in the shape of an inverted dish and comprises a metal top wall 29 (FIG. 3) and a depending skirt 30 which is formed integrally with the top wall. The top wall 29 is spaced upwardly from the top plate 21 of the shoe 14 while the skirt 30 extends around and is spaced outwardly from the outer periphery of the shoe. Accordingly, the shroud and the shoe coact to define the chamber 26, the latter being located above and around the shoe. A rubber strip 31 may be secured around the skirt 30 to increase the effective length thereof and thereby enable the skirt to extend near the work surface without marring the latter.

In keeping with the invention, the shoe 14 and the shroud 25 are connected together to gyrate in unison. For this purpose, a comparatively thick metal plate 33 (FIG. 3) overlies the top wall 29 of the shroud 25 and receives screws 34 which extend through the top wall and are threaded into bosses 35 projecting upwardly from the plate 21 of the shoe 14 adjacent the four corners thereof, the bosses serving as spacers to keep the shroud located above the shoe. The drive mechanism 24 is operably connected to the plate 33 and thus acts to gyrate both the shroud and the shoe. To prevent these members from rotating, an annular rubber boot 40 is connected between the casing 13 and the upper side of the plate 33.

Figure 1:
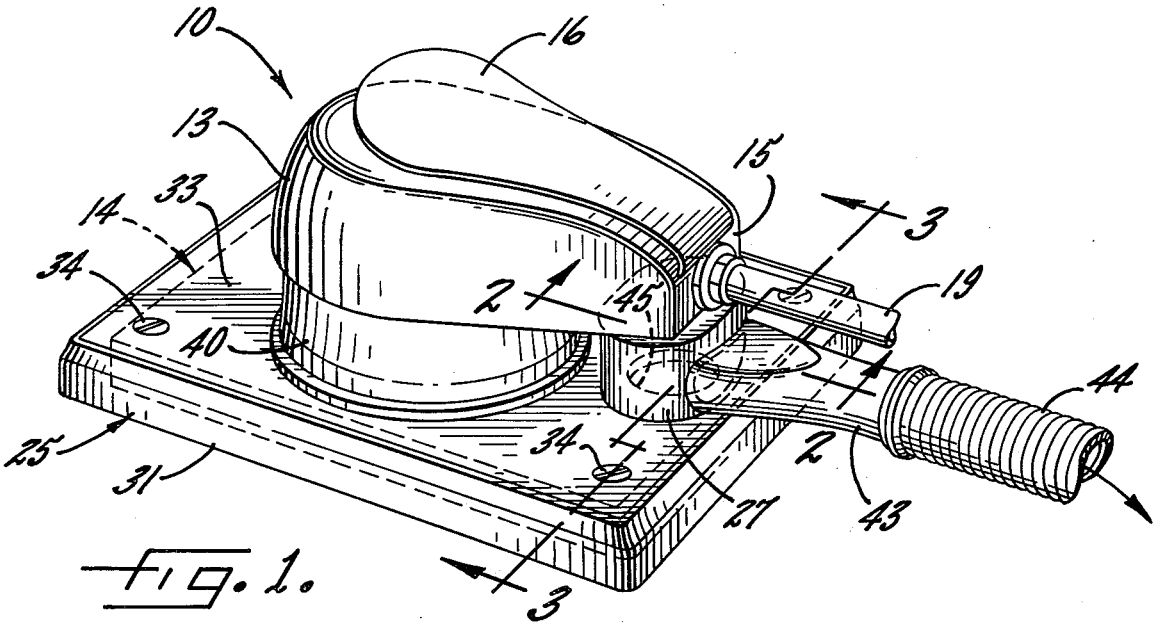
FIG. 1 is a perspective view of a new and improved abrading machine incorporating the unique features of the present invention.

The fitting 27 preferably is in the form of an inverted cup which is located in overlying relation with the rear portion of the plate 33. The upper end of the cup 27 is secured rigidly to the underside of the handle 15 by screws 41 (FIG. 2) while the lower open end of the cup is located in very closely spaced relationship with the plate 33 and preferably does not contact the plate. A tube 43 extends through and is attached to the rear wall of the cup 27 and is adapted to receive a flexible line or hose 44 (FIG. 1) extending from a suction unit (not shown) having a dust collecting receptacle.

Further in keeping with the invention, a hole 45 is formed through the top wall 29 and the plate 33 of the shroud 25 and underlies the open end of the cup 27. The cup is significantly larger than the hole 45 and thus the cup and the hole remain in communication at all times even though the hole gyrates beneath the stationary cup.

With the foregoing arrangement, suction is applied to the cup 27 via the hose 44 and the tube 43. By virtue of the hole 45, suction is created within the chamber 26 and thus an upwardly flowing draft of air is produced around the entire outer periphery of the shoe 14 within the space between the shoe and the skirt 30. Accordingly, when the machine 10 is operated, abrading dust is sucked upwardly between the shoe 14 and the skirt 30 and passes into the chamber 26. The dust then passes through the hole 45 and into the cup 27 and is exhausted through the tube 43 and the hose 44 to the dust collecting receptacle. This arrangement, while being of simple and inexpensive construction, is very effective in operation since an upwardly flowing curtain of air surrounds the entire outer periphery of the shoe to preclude the escape of dust.

I claim:

1. An abrading machine comprising a hollow case, a rotary motor within said case, an abrading shoe located beneath said case, drive mechanism within said case and connected between said motor and said shoe to cause the latter to move with non-rotary motion relative to said case and said motor, a dust shroud connected to said shoe to move in unison with the shoe, said shroud comprising a top wall located above and spaced upwardly from the top of said shoe and further comprising a skirt depending from said top wall and extending around the outer periphery of said shoe, said skirt being spaced outwardly from the periphery of said shoe whereby abrading dust may pass into said shroud between said skirt and the periphery of said shoe, a hole extending through said top wall of said shroud, a hollow, downwardly opening fitting rigid with and located outside of said case and communicating with said hole, said fitting being sufficiently large to remain in communication with said hole in all positions of said shoe and said shroud, and means on said fitting for receiving a line for creating suction in said fitting and said shroud whereby abrading dust may be sucked into said shroud and passes through said hole and into said fitting and said suction line.

2. An abrading machine as defined in claim 1 in which said fitting is defined by an inverted cup having its open end disposed closely adjacent said top wall and overlying said hole, said suction line extending into one wall of said cup.

3. An abrading machine as defined in claim 1 in which said shoe and said shroud are substantially rectangular in shape, upright spacers adjacent the corners of said shoe and said shroud for keeping the top wall of said shroud spaced above said shoe, and means extending through said spacers for securing said shroud and said shoe for movement in unison.

* * * * *